US007628209B2

(12) United States Patent
Berry et al.

(10) Patent No.: US 7,628,209 B2
(45) Date of Patent: Dec. 8, 2009

(54) TUBING DRIVEN PROGRESSING CAVITY PUMP AND METHOD OF PUMPING WELL FLUID FROM A WELL

(75) Inventors: Douglas W. Berry, Broken Arrow, OK (US); Bruce E. Proctor, Tulsa, OK (US); Kelley L. Phillips, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 192 days.

(21) Appl. No.: 11/370,337

(22) Filed: Mar. 8, 2006

(65) Prior Publication Data

US 2007/0209800 A1 Sep. 13, 2007

(51) Int. Cl.
*E21B 43/00* (2006.01)

(52) U.S. Cl. ..... 166/369; 166/382; 166/105; 166/68.5

(58) Field of Classification Search ..... 166/369, 166/105, 382, 68.5
See application file for complete search history.

(56) References Cited

U.S. PATENT DOCUMENTS

| | | | | |
|---|---|---|---|---|
| 3,249,054 | A * | 5/1966 | Hill | 417/440 |
| 3,932,072 | A | 1/1976 | Clark | |
| RE29,180 | E | 4/1977 | Clark | |
| 4,923,376 | A | 5/1990 | Wright | |
| 5,103,901 | A * | 4/1992 | Greenlee | 166/120 |
| 5,113,937 | A | 5/1992 | Cholet | |
| 5,417,281 | A * | 5/1995 | Wood et al. | 166/68 |
| 5,611,397 | A * | 3/1997 | Wood | 166/68 |
| 6,019,583 | A * | 2/2000 | Wood | 418/48 |
| 6,557,639 | B1 | 5/2003 | Matthews et al. | |
| 6,729,391 | B2 | 5/2004 | Hill et al. | |

FOREIGN PATENT DOCUMENTS

| | | | |
|---|---|---|---|
| DE | 3902902 | A1 | 8/1990 |

* cited by examiner

*Primary Examiner*—Jennifer H Gay
*Assistant Examiner*—Robert E Fuller
(74) *Attorney, Agent, or Firm*—Bracewell & Giuliani LLP

(57) ABSTRACT

A progressing cavity well pump system has a stator secured to a string of tubing. A drive head at the surface rotates the tubing and the stator. The pump rotor is held against rotation by an anchor mechanism. The tubing, stator, rotor and anchor mechanism are installed in the well in a single trip.

17 Claims, 4 Drawing Sheets

TUBING DRIVEN PROGRESSING CAVITY PUMP AND METHOD OF PUMPING WELL FLUID FROM A WELL

FIELD OF THE INVENTION

This invention relates in general to well pumping systems, and in particular to a progressing cavity pump that is driven by tubing suspended in the well.

BACKGROUND OF THE INVENTION

One type of well pump, known as a progressing cavity pump, has a stator that comprises a tubular housing with an elastomeric liner in its interior. The liner has a central passage through it with helical cavities. A rotor extends through the stator, the rotor being of rigid material such as metal and having a helical exterior. When the rotor is rotated, fluid is forced through the passage in the stator and up the well.

In one type of system, the rotor is driven by a string of rods that extends upward to a drive head at the surface that rotates the rods. The string of rods extends within a production tubing that is coupled to the stator for conveying the produced fluid up the well. Normally, the stator is secured to the lower end of the tubing and installed when running the tubing. The rotor is then secured to the lower end of the string of rods and lowered into engagement with the stator.

While these systems work well, the flow area up the tubing is reduced by the rods. The diameter of the tubing is limited by the size of the casing. In some wells, the casing size results in tubing that has a smaller flow area than desired because of the restriction created by the rods.

Further, the installation of a rod-driven progressing cavity pump system requires two trips. First the operator runs the string of tubing with the stator on the lower end, then runs the string of rods with the rotor on the lower end. Reducing the amount of time to install a progressing cavity well pump would save on the installation cost.

SUMMARY OF THE INVENTION

In the pumping system of this invention, drive rods are not required and the progressing cavity pump can be installed in a single trip. Instead of drive rods, the string of tubing is rotatably driven. The stator of the progressing cavity pump is in operative engagement with the tubing for rotation therewith and relative to the rotor for pumping well fluid up the tubing.

An anchor mechanism is in operative engagement with the rotor and the casing for preventing rotation of the rotor as the stator rotates. Preferably the stator communicates with the interior of the tubing for pumping the well fluid through the tubing to the surface. A flexible joint extends between the lower end of the rotor and the anchor. Preferably the tubing, stator, rotor, flexible joint, and anchor are made up in an assembly that is installed and retrieved from the well simultaneously.

DETAILED DESCRIPTION OF THE INVENTION

Figure 1:
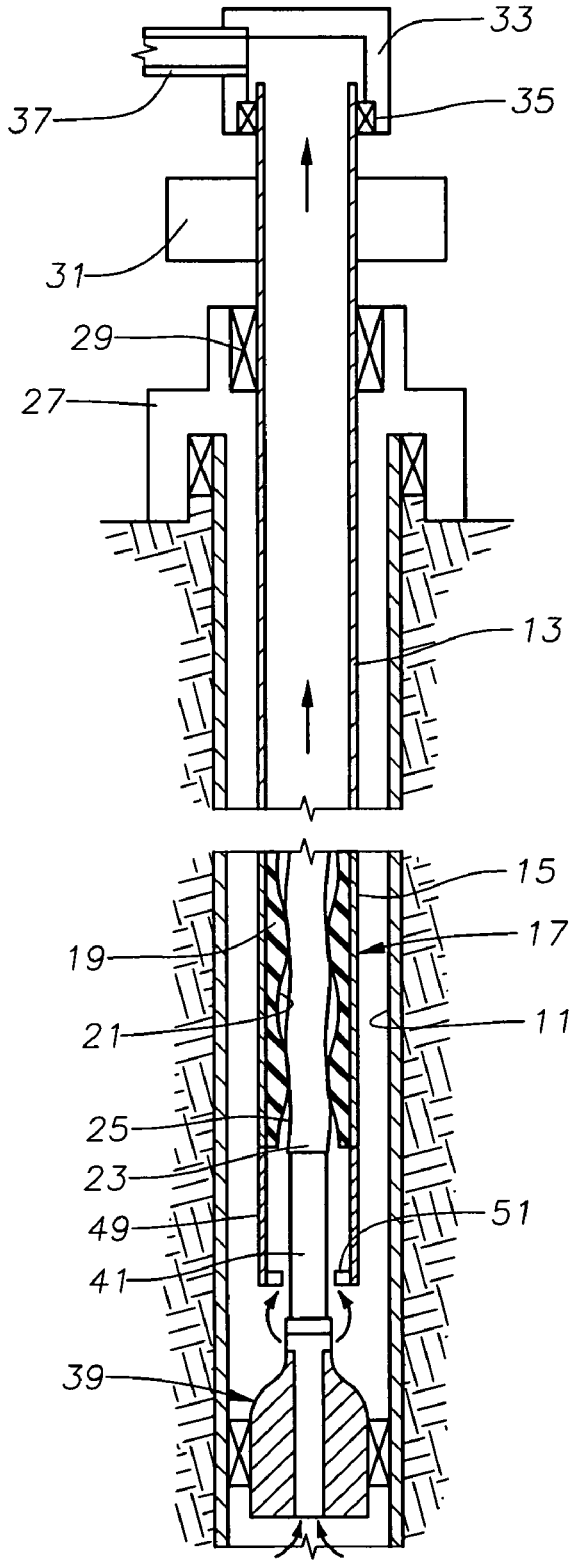
FIG. 1 is a schematic sectional view illustrating a well pumping system in accordance with this invention.

Referring to FIG. 1, a well has a casing 11 cemented in place. A string of tubing 13 is shown suspended within casing 11. Tubing 13 may comprise conventional well production tubing made up of separate joints of pipe secured together by threads. Alternately, tubing 13 may comprise a single section of continuous coiled tubing. The term "tubing" as used herein means any type of conduit, including rods that are hollow.

A stator 15 of a conventional progressing cavity pump 17 is secured to the lower end of tubing 13. Stator 15 has a tubular housing, normally of metal, with an elastomeric liner 19 within the interior. Liner 19 has a helical inner passage 21. A rotor 23 is located within passage 21 of stator 15. Rotor 23 is normally metal and has a helical exterior 25. When relative rotation occurs between rotor 23 and stator 15, fluid will be pumped up tubing 13.

Tubing 13 extends to a wellhead assembly 27 and is rotated during operation of progressing cavity pump 17. A set of bearings and seals 29 seals between wellhead 27 and the exterior of tubing 13. A drive source 31, which comprises an electrical motor and a bearing box, is coupled to tubing 13 to rotate tubing 13. Drive source 31 may be generally of the same type as used in the prior art to rotate drive rods. A manifold 33 is located at the upper end of tubing 13 for receiving well fluid flowing upward from pump 17. Manifold 33 is stationary and has bearings and seals 35 that enable relative rotation between manifold 33 and tubing 13. Manifold 33 has an outlet conduit 37 that leads to a facility for further processing of the well fluid.

Stator 15 rotates in unison with tubing 13. An anchor 39 is secured to the lower end of rotor 23 to prevent rotation of rotor 23 while stator 15 rotates. Anchor 39 may comprise various devices that can be set to grip casing 11 to prevent rotation and vertical movement of anchor 39. Preferably, a flexible shaft 41 extends between anchor 39 and the lower end of rotor 23. Even though rotor 23 does not rotate, the rotation of stator 15 will cause lateral oscillations of rotor 23. Flex shaft 41 is typically metal, but has sufficient length and flexibility to accommodate those oscillations. The lower end of flex shaft 41 will be stationary while the upper end will oscillate laterally with rotor 23. As shown by the arrows in FIG. 1, well fluid flows into the lower end of stator 15 and is discharged into tubing 13.

Figure 2A:
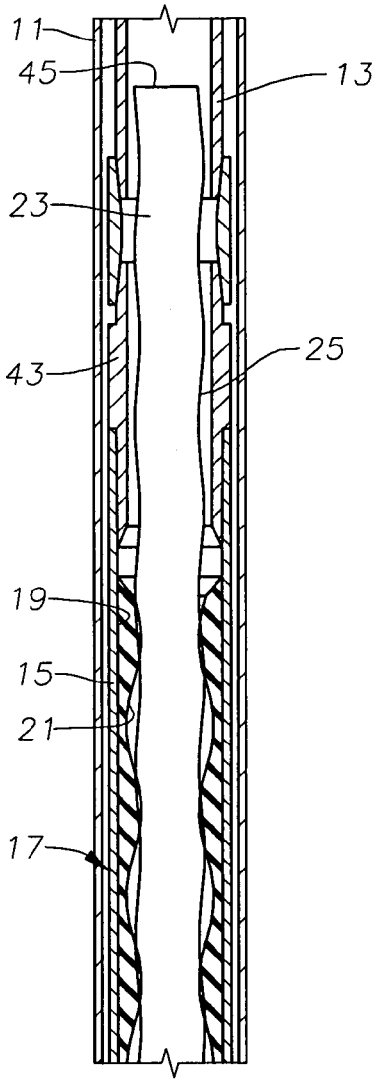
FIGS. 2A-2C comprise a sectional view of a portion of the system of FIG. 1, and showing the stator in a lower position relative to the rotor.
Figure 2B:
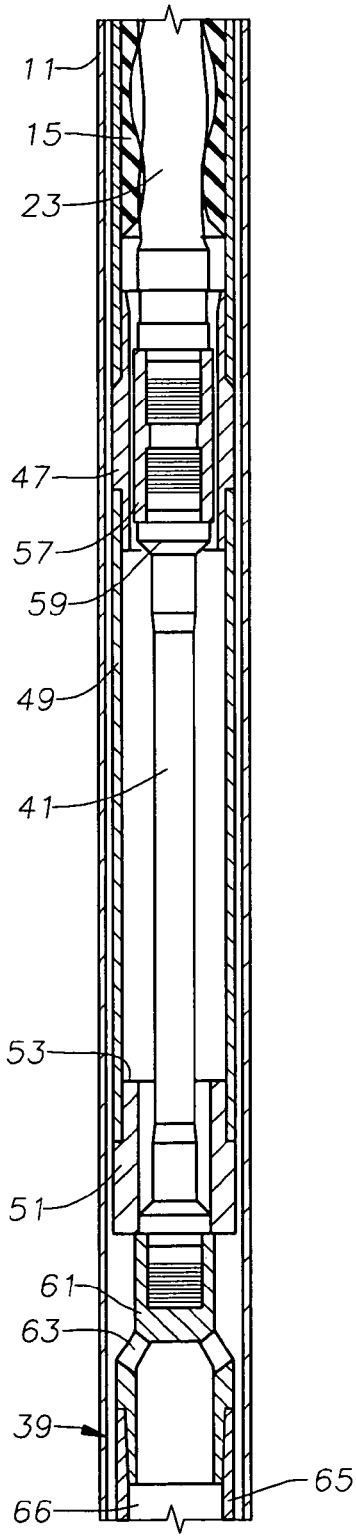
Figure 2C:
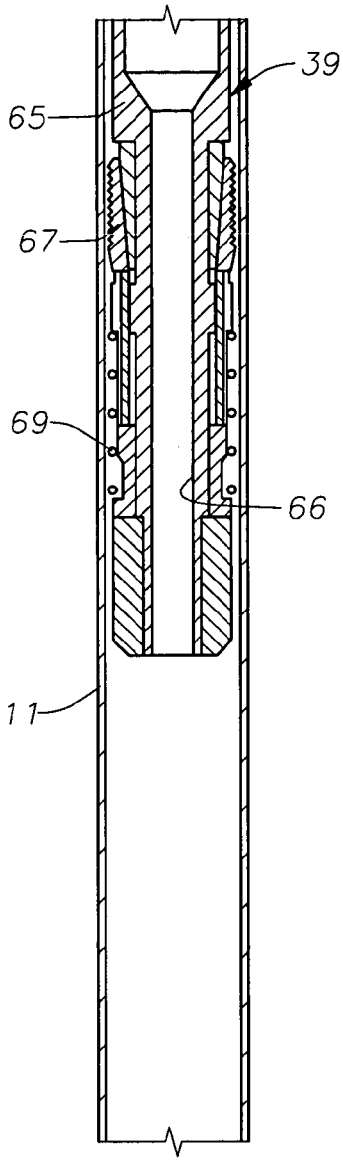

FIGS. 2A-2C shows stator 15 in a lower position relative to anchor 39, which is a position that may be utilized during the installation process to determine the proper vertical alignment of rotor 23 within stator 15. The upper end 45 of rotor 23 is protruding a substantial distance above the upper end of liner 19 in this lower position. Preferably, stator 15 is secured by threads to an upper adapter 43, which in turn is secured to the lower end of tubing 13. In this lower position, the upper end 45 of rotor 23 may extend through upper adapter 43 into tubing 13.

Referring to FIG. 2B, a lower adapter 47 is secured by threads to the lower end of the housing of stator 15. Lower adapter 47 has a coupling for connecting stator 15 to a flex shaft housing 49. Flex shaft housing 49 is a cylindrical member extending downward from lower adapter 47. A collar 51 is secured to the lower end of flex shaft housing 49. Collar 51 has an internal diameter that is smaller than the internal diameter of flex shaft housing 49, defining a reduced diameter section with an upward facing internal shoulder 53. Lower adapter 47, flex shaft housing 49 and collar 51 rotate in unison with stator 15.

Figure 4A:
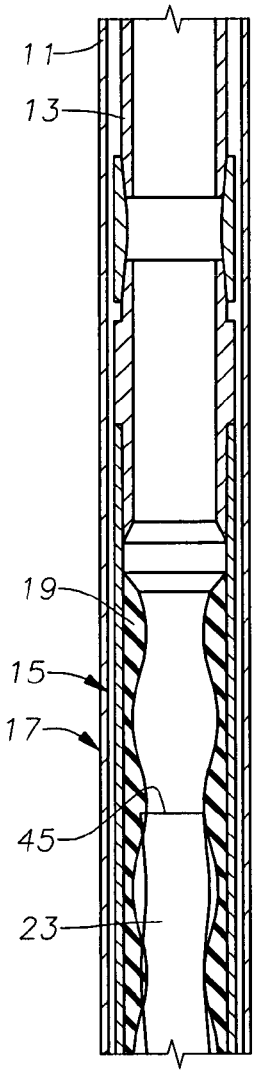
FIGS. 4A-4C comprise a sectional view similar to FIGS. 2A-2C, and showing the pump assembly with the stator in an upper position relative to the rotor.
Figure 4B:
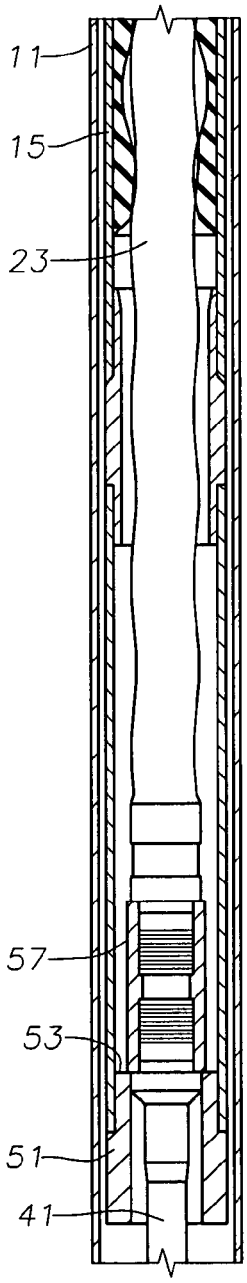

Flex shaft 41 is secured by a coupling 57 to the lower end of rotor 23. Flex shaft 41 has an annular stop 59 formed on it against which coupling 57 makes up. Coupling 57 is a sleeve having an outer diameter greater than stop 59 and greater than the inner diameter of collar 51, defining an upper external shoulder that will land on internal shoulder 53 when stator 15 is in the upper or retrieval position relative to rotor 23, as shown in FIG. 4B. The outer diameter of stop 59 is slightly less than the inner diameter of collar 51 to enable flex shaft 41 to be inserted into and assembled within flex shaft housing 49.

Referring still to FIG. 2B, an adapter 61 secures the lower end of flex shaft 41 to anchor 39. Another stop similar to stop 59 is contacted by adapter 61 when adapter 61 is made up to the lower end of flex shaft 41. Adapter 61 has an outer diameter larger than the inner diameter of collar 51, defining a lower external shoulder that will abut the lower end of collar 51 when stator 15 is in the lower position shown in FIG. 2B. Adapter 61 is preferably hollow, having a plurality of ports 63 leading from the interior to the exterior. The lower portion of adapter 65 is of larger diameter than the upper portion, being approximately the same diameter as the outer diameter of stator 15. The lower portion of adapter 61 is secured by threads to a tubular mandrel 65.

Referring to FIG. 2C, mandrel 65 is part of anchor 39 and has a passage 66 extending through it for transmitting well fluid to ports 63 in adapter 65. Slips 67 are carried by mandrel 65 for movement between a retracted position and an engaged position with casing 11. Slips 67 have and teeth or grooves on the exterior and tapered interior surfaces that engage a tapered cam surface on mandrel 65. When slips 67 are pushed upward and outward on the cam surface of mandrel 65, they will frictionally grip the inner diameter of casing 11. A coil spring 69 urges slips 67 to the upper position. Anchor 39 has a retaining mechanism, such as one or more shear pins (not shown) operatively engaged between slips 67 and mandrel 65, that will allow anchor 39 to be run into the well with slips 67 in a retracted position (not shown). In one embodiment, dropping tubing 13, then rapidly stopping downward movement of tubing 13 creates a jarring movement that shears the shear pins. Spring 69 then forces slips 67 to the engaged position. Also, a key or spline (not shown) prevents relative rotation between mandrel 65 and slips 67.

In operation, the operator will assemble anchoring device 39 to the lower end of flex shaft 41. Rotor 23 will be located within passage 21 of stator 15. The operator secures stator 15 to the lower end of tubing 13, then lowers the entire assembly into the well simultaneously. When at the desired depth, the operator will actuate anchor 39 to cause slips 67 to move to the engaged position shown in FIG. 2C.

Figure 3A:
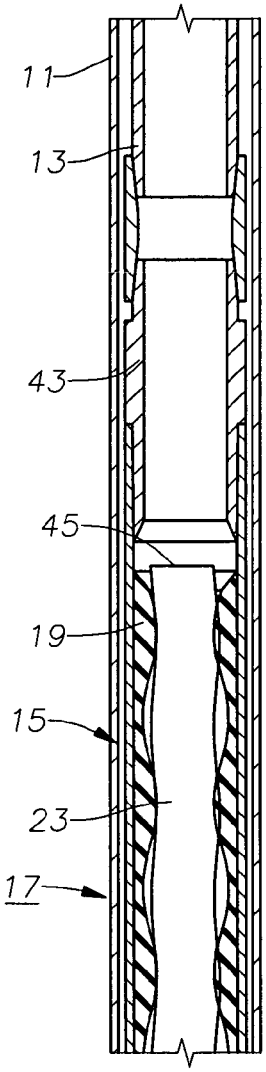
FIGS. 3A-3C comprise a sectional view of the system as shown in FIGS. 2A-2C, but showing the pump assembly in an operational position.
Figure 3B:
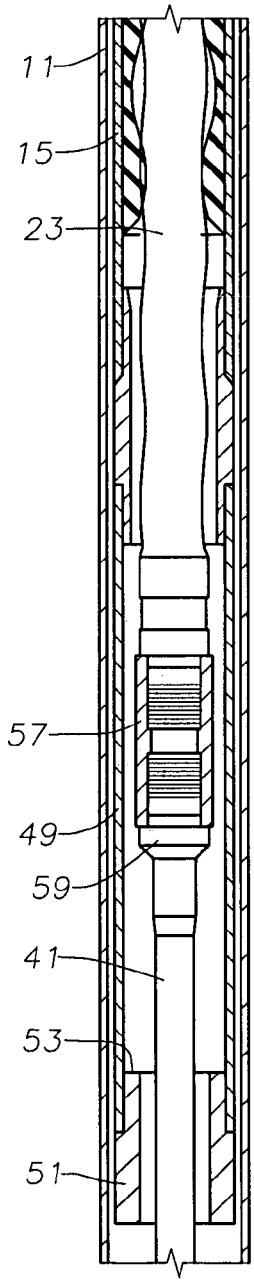
Figure 3C:
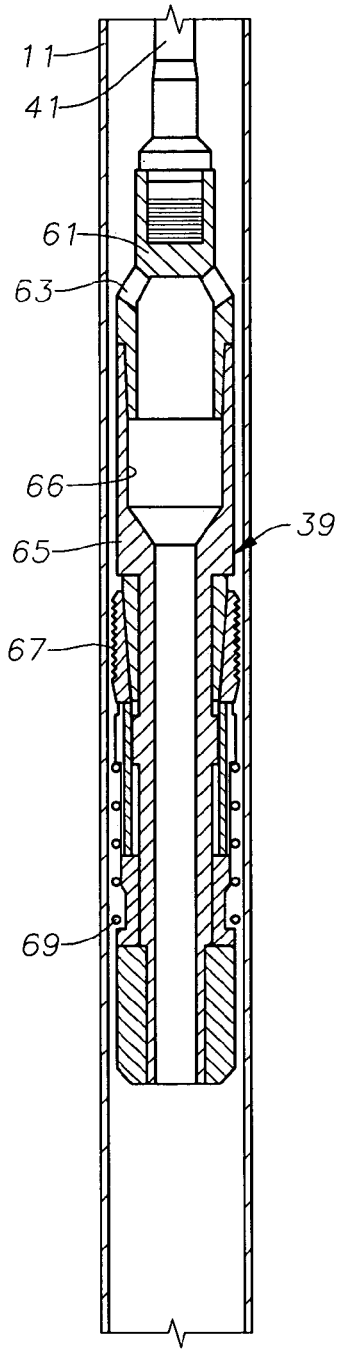

After setting, the operator moves rotor 23 to desired axial position in stator 15 for operation, which is shown in FIGS. 3A-3C. This procedure can be done by lowering tubing 13 after setting anchor 39. Tubing 13 will move downward relative to anchor 39 until collar 51 lands on the upper end of adapter 61, as shown in FIGS. 2A-2C. The weight indicator at the surface will indicate that stator 15 is in the lower position. Stator 15 will move downward with tubing 13, but rotor 23 will remain stationary because of the engagement of anchor 39 with casing 11. The operator may then pick up tubing 13 a known distance so as to place stator 15 in the intermediate or operational position relative to rotor 23, shown in FIGS. 3A-3C. In the operational position, stop 59 is spaced above internal shoulder 53, and adapter 61 is spaced below collar 59 (FIG. 3C). The upper end 45 of rotor 23 will be substantially flush with the upper end of elastomeric liner 19. When moving to the operational position, the operator could pick up tubing 13 until collar 51 engages coupling 57, as shown in FIG. 4B, at which time the weight indicator should begin to increase due to the frictional engagement of slips 67 with mandrel 65. The operator would then lower tubing 13 a short distance to place stator 15 in the operational position.

The operator assembles drive head 31 and manifold 33 (FIG. 1). The operator begins rotating tubing 13, which will cause stator 15 and flex shaft housing 49 to rotate in unison. Anchor 39, flex shaft 41, and rotor 23 will not rotate because of the frictional engagement of anchor 39 with casing 11. The relative rotation causes well fluid to flow up mandrel passage 66, through adapter ports 63, collar 51, flex shaft housing 49 and into the lower end of stator 15. The well fluid flows up stator passage 21 into tubing 13. The well fluid flows up tubing 13 (FIG. 1) through manifold 33 and out conduit 37. During the rotational movement, the upper end of flex shaft 41 will oscillate laterally with the lower end of rotor 23. The lower end of flex shaft 41 will remain stationary.

Figure 4C:
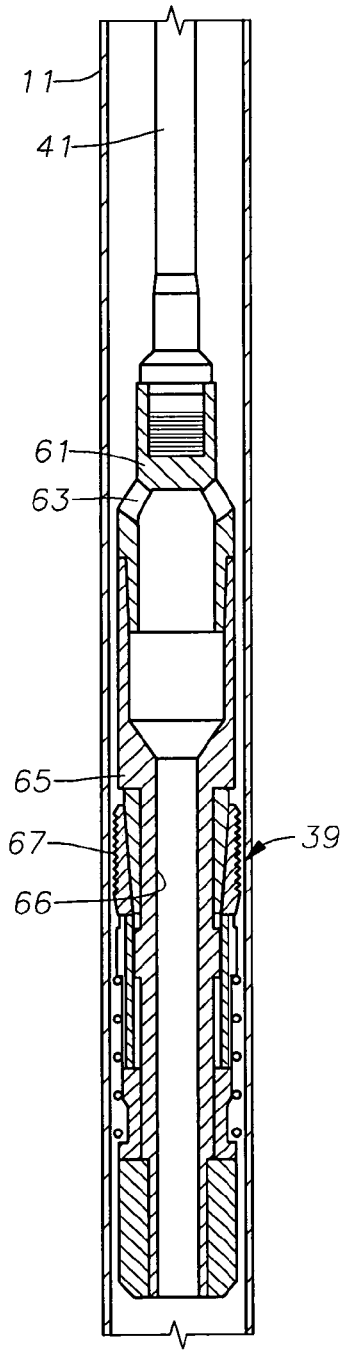

To retrieve pump 17 for maintenance or replacement, the operator will disconnect drive source 31 and manifold 33, then pull upward on tubing 13. The upward pull will cause stator 15 to move to the upper position shown in FIGS. 4A-4C. In this position, upper end 45 of rotor 23 is below the upper end of elastomeric liner 19. Internal shoulder 53 on collar 51 will be in engagement with the lower end of coupling 57. Continued upward pull on tubing 13 transmits through flex shaft 41 to anchor mandrel 65. As mandrel 65 moves upward, slips 67 retract and release the grip on casing 11. The entire assembly, including tubing 13, stator 15, rotor 23 and anchor 39 are pulled out simultaneously as a single assembly.

The invention has significant advantages. By rotating the tubing, a string of drive rods is not required. Omitting the drive rods allows a smaller diameter tubing to be deployed with the same or larger flow area than a larger diameter tubing. In addition to weighing less and generally costing less, a smaller diameter tubing can be useful for wells with smaller diameter casing. Additionally, coupling the anchor, rotor and stator together in the manner shown allows the assembly to be run along with the tubing in a single trip. This installation saves on rig time that is normally required for rod-driven progressing cavity pump installations.

While the invention has been shown in only one of its forms, it should be apparent to those skilled in the art that it is not so limited but is susceptible to various changes without departing from the scope of the invention.

What is claimed is:

1. An apparatus for pumping a cased well, comprising:

a wellhead assembly for location at an upper end of a cased well;

a string of tubing for suspension by the wellhead assembly within the well, the string of tubing having an upper portion at the wellhead assembly;

a drive source at the wellhead assembly and coupled to the upper portion of the string of tubing for rotating an entire length of the string of tubing;

a progressing cavity pump having a housing containing a stator and secured to a lower end of the string of tubing for rotation therewith, the housing having an open lower end for fluid communication with well fluid in the cased well and an open upper and in fluid communication with an interior of the string of tubing;

a rotor located within the stator;

an anchor mechanism located below the stator for gripping engagement with casing;

a shaft coupled to a lower end of the rotor and extending downward through the open lower end of the housing to the anchor mechanism to prevent rotation of the rotor; and wherein the shaft has a smaller outer diameter than the open lower end of the housing, defining an annular intake port between the shaft and the open lower end of the housing for well fluid in the casing.

2. The apparatus according to claim 1, wherein the stator housing has an outer diameter larger than an inner diameter of the string of tubing.

3. The apparatus according to claim 1, wherein:

the interior of the string of tubing has a flow area for the well fluid being pumped upward to the surface that is constant from the stator to its upper portion.

4. The apparatus according to claim 1, wherein the shaft comprises:

a flexible joint extending between a lower end of the rotor and the anchor mechanism, the upper end of the flexible joint oscillating in unison with the rotor, the lower end of the flexible joint being held stationary by the anchor mechanism.

5. The apparatus according to claim 1, wherein the drive source comprises an electrical motor operatively engaged with the upper portion of the string of tubing.

6. The apparatus according to claim 1, further comprising:

a manifold in engagement with the upper portion of the string of tubing above where the drive source couples to the string of tubing for receiving well fluid flowing up the string of tubing, the manifold having a closed top and an open bottom that receives an open upper end of the string of tubing, the manifold having a side outlet for discharging well fluid received from the tubing; and bearings located between the manifold and the string of tubing to enable the manifold to be non rotatable while the string of tubing rotates.

7. An apparatus for pumping well fluid, comprising:

a string of casing in a well;

a wellhead at an upper end of the string of casing;

a string of tubing suspended within the casing, the string of tubing extending through and having an upper portion extending above the wellhead;

a drive head above the wellhead and in engagement with the upper portion of the string of tubing for rotating an entire length of the string of tubing;

a progressing cavity pump having a stator secured to and extending below a lower end of the string of tubing for rotation in unison with the string of tubing, the stator having a stator housing with an outer diameter larger than an inner diameter of the string of tubing;

a progressing cavity pump rotor located within the stator;

a single flow passage extending through the progressing cavity pump, the flow passage with the interior of the of tubing for pumping well fluid up the string of tubing to the manifold;

an anchor mechanism in operative engagement with the rotor and gripping the casing to prevent rotation of the rotor as the stator rotates; wherein the anchor mechanism comprises:

a mandrel carried by the rotor; and a plurality of slips mounted to the mandrel for outward movement into engagement with the casing in response to axial movement of the slips relative to the mandrel; wherein the stator has an open lower end in fluid communication with well fluid in the casing; and the mandrel has a passage therethrough with an upper port in fluid communication with well fluid in the casing above the mandrel for flowing well fluid upward into the casing and from the casing into the stator.

8. The apparatus according to claim 7, wherein:

the entire length of the string of tubing has an unobstructed flow area proportional to its inner diameter.

9. The apparatus according to claim 7 wherein rotation of the stator causes lateral oscillations of the rotor, and wherein the apparatus further comprises:

a flexible joint extending between a lower end of the rotor and the anchor mechanism, the upper end of the flexible joint oscillating in unison with the rotor, the lower end of the rotor being held stationary by the anchor mechanism.

10. The apparatus according to claim 7, wherein the tubing, stator, rotor, and anchor mechanism comprise an assembly that is installed in and retrieved from the well simultaneously.

11. The apparatus according to claim 7, further comprising:

a flex shaft housing secured to a lower end of the stator;

a flex shaft secured to a lower end of the rotor and extending through the flex shaft housing;

the upper end of the flex shaft oscillating in unison with the rotor, the lower end of the rotor being held stationary by the anchor mechanism; and wherein the anchor mechanism is carried by the flex shaft and has an outer diameter larger than an internal diameter of the flex shaft housing.

12. An apparatus for pumping well fluid, comprising:

a string of tubing for suspension within casing of a well, the string of tubing having an upper portion adapted to be located above the well;

a drive head in engagement with the upper portion of the string of tubing for rotating an entire length of the string of tubing;

a progressing cavity pump stator secured to and extending below a lower end of the string of tubing for rotation in unison with the string of tubing, the stator having a stator housing with an outer diameter larger than an inner diameter of the string of tubing;

a progressing cavity pump rotor located within the stator;

an anchor mechanism in operative engagement with the rotor for gripping the casing to prevent rotation of the rotor as the stator rotates;

a tubular flex joint housing secured to a lower end of the stator, the flex joint housing having an internal shoulder therein; and a flex shaft extending through the flex joint housing, the flex shaft having an upper end secured to the rotor and a lower end secured to the anchor mechanism.

13. An apparatus for pumping well fluid, comprising:

a string of tubing for suspension within casing of a well;

a drive head in engagement with an upper portion of the tubing for rotating the tubing;

a progressing cavity pump stator in operative engagement with the tubing for rotation in unison with the tubing;

a progressing cavity pump rotor located within the stator;

an anchor mechanism in operative engagement with the rotor for gripping the casing to prevent rotation of the rotor as the stator rotates;

a tubular flex shaft housing secured to a lower end of the stator for rotation therewith and having a reduced diameter section;

a flex shaft having an upper end secured to the rotor and a lower end secured to the anchor mechanism;

upper and lower external shoulders above and below the reduced diameter section, the external shoulders being movable in unison with the flex shaft and unable to pass through the reduced diameter section; and wherein the stator is axially movable relative to the rotor between a lower position with the reduced diameter section engaging the lower external shoulder, and an upper position with the reduced diameter section engaging the upper external shoulder.

14. A method for pumping well fluid from a cased well, comprising:

(a) inserting a rotor into a stator of a progressing cavity pump, the stator having an open lower end;

(b) operably coupling the stator to a string of tubing;

(c) lowering the string of tubing into the well and rotatably supporting an upper end of the string of tubing with a wellhead assembly at an upper end of the well, thereby defining an annulus between the stator and a casing in the well, (d) coupling a drive source to the upper end of the string of tubing;

(e) anchoring the rotor to the casing to prevent rotation of the rotor while the stator rotates; and (f) rotating with the drive source an entire length of the string of tubing and the stator and flowing well fluid from the portion of the annulus surrounding the stator into the open lower end of the stator to cause the pump to pump well fluid up the string of tubing to the surface.

15. The method according to claim 14, wherein step (C) further comprises:

lowering the string of tubing, the stator and the rotor into the well simultaneously.

16. The method according to claim 14, wherein step (e) further comprises:

securing an anchoring assembly to a lower end of the rotor; and frictionally engaging casing in the well with the anchoring assembly to prevent rotation of the rotor while the stator rotates.

17. The method according to claim 14 wherein step (b) comprises securing the stator to a lower end of the string of tubing such that the stator extends below the string of tubing.

* * * * *

UNITED STATES PATENT AND TRADEMARK OFFICE

CERTIFICATE OF CORRECTION

PATENT NO. : 7,628,209 B2
APPLICATION NO. : 11/370337
DATED : December 8, 2009
INVENTOR(S) : Douglas W. Berry et al.

It is certified that error appears in the above-identified patent and that said Letters Patent is hereby corrected as shown below:

Column 3, line 33, delete "and" before "teeth"

Column 5, line 56, after "passage" insert -- being defined by clearances between the stator and the rotor and being in fluid communication --

Column 5, line 56, after "interior of the" insert -- string --

Signed and Sealed this

Tenth Day of August, 2010

David J. Kappos

David J. Kappos
*Director of the United States Patent and Trademark Office*